US011766100B1

(12) United States Patent
Butler

(10) Patent No.: US 11,766,100 B1
(45) Date of Patent: Sep. 26, 2023

(54) INTERCHANGEABLE PIECE OR SET OF JEWELRY

(71) Applicant: Wonderment, Inc., Great Neck Plaza, NY (US)

(72) Inventor: Jerome D. Butler, Great Neck Plaza, NY (US)

(73) Assignee: WONDERMENT, INC., Great Neck Plaza, NY (US)

( * ) Notice: Subject to any disclaimer, the term of this patent is extended or adjusted under 35 U.S.C. 154(b) by 0 days.

(21) Appl. No.: 18/109,581

(22) Filed: Feb. 14, 2023

(51) Int. Cl.
*A44C 17/02* (2006.01)

(52) U.S. Cl.
CPC ..... *A44C 17/0216* (2013.01)

(58) Field of Classification Search
CPC .... A44C 17/0216; A44C 9/00; A44C 17/0208
See application file for complete search history.

(56) References Cited

U.S. PATENT DOCUMENTS 470,751 A * 3/1892 Fink ..... A44C 17/0208 63/29.1
1,160,723 A 11/1915 Lander
1,774,347 A 8/1930 Bainton
3,509,734 A 5/1970 Lederer
5,138,855 A 8/1992 Faris
11,464,302 B1 10/2022 Butler
2019/0104813 A1 4/2019 Butler

FOREIGN PATENT DOCUMENTS

DE 202013101780 U1 * 6/2013 ..... A44C 17/0216
FR 2777756 A1 * 10/1999 ..... A44C 17/0208

OTHER PUBLICATIONS

U.S. Appl. No. 15/726,795, filed Oct. 6, 2017 (12 pages).

* cited by examiner

*Primary Examiner* — Jack W Lavinder
(74) *Attorney, Agent, or Firm* — Kilyk & Bowersox, P.L.L.C.

(57) ABSTRACT

An interchangeable piece of jewelry including a base and a head mount. The base can include a post extending therefrom and the head mount can include a receptacle. The post has an outer wall defining a first circumferential groove. The receptacle is defined by an inner wall that further defines a second circumferential groove. A spring is disposed within the first circumferential groove. A spring retaining wall contains the spring within the first circumferential groove. When the post is placed within the receptacle, the circular spring extends from the first circumferential groove into the second circumferential groove, releasably securing the head mount to the base.

19 Claims, 4 Drawing Sheets

INTERCHANGEABLE PIECE OR SET OF JEWELRY

FIELD OF THE INVENTION

The present invention relates to jewelry. The present invention also relates to pairing and mounting jewelry.

BACKGROUND OF THE INVENTION

The manufacture of fine jewelry and costume jewelry involves the placement and connection of various parts. Jewelry commonly includes a base worn by the user and a head mount. A diamond or other stone is mounted to the head mount. Jewelry is generally offered to the customer as a finished piece. For example, engagement rings are sold as a shank (base) and head mount already fused together.

At jewelry stores or outlets, customers typically try on a piece of jewelry prior to purchase. Currently, customers are unable to view different combinations of head mounts and bases prior to purchasing the jewelry because the heads and bases are already fused together.

Accordingly, there is a need for a quick connect and disconnect of head mounts and bases of jewelry, to view different combinations prior to purchase.

SUMMARY OF THE INVENTION

A feature of the present invention is to provide jewelry that has interchangeable head mounts and bases.

A further feature of the present invention is to provide a base that is interchangeable with different head mounts.

A further feature of the present invention is to provide a head mount that is interchangeable with different bases.

A further feature of the present invention is to provide a plurality of head mounts and a plurality of bases that can be releasably attached to one another.

A further feature of the present invention is to provide a plurality of head mounts and a plurality of bases that can be releasably attached to one another, and upon selection of a pair of a head mount and a base, to fixedly secure the pair together.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to an interchangeable piece of jewelry. The interchangeable piece of jewelry includes a base and a head mount. The head mount includes a setting configured to retain a jewel therein.

A post extends from one of the base and the head mount. The post includes a sidewall that defines a first circumferential groove. A spring retaining wall extends between an upper rim and a lower rim of a portion of the first circumferential groove such that a space is defined between an inside surface of the spring retaining wall and the sidewall at the first circumferential groove.

A receptacle is defined by an inner wall of the other of the base and the head mount, the receptacle having an opening at an outer surface and the inner wall defining a second circumferential groove. When a circular spring is disposed within the first circumferential groove, and the post is disposed within the receptacle, the spring partially protrudes from the first circumferential groove into the second circumferential groove, retaining the head mount to the base.

The circular spring can be a jump spring including an opposed first end and second end facing one another and spaced apart from one another.

The setting of the head mount can include a plurality of adjustable prongs to retain the jewel therein.

The spring retaining wall can include an upper end attached to the upper rim and a lower end attached to the lower rim.

The post can extend from an upper surface of the base and the head mount can include the inner wall defining the receptacle. The post can include a post head above the first circumferential groove and the post head can have a conical shape, a semi-conical shape, a fully conical shape, or another tapered shape. For example, the conical shape of the post head can be a frusto-conical shape having a flat top or an indent at a tip of the post head, the indent defining a conical shape.

The interchangeable piece of jewelry can include at least one rod extending from one of the head mount and the base, and at least one slot defined by the other of the head mount and the base. The rod fits within the slot when the post is disposed within the receptacle.

The at least one rod can be a first rod and a second rod, and the at least one slot can be a first slot and a second slot. The first rod fits within the first slot and the second rod fits within the second slot when the post is disposed within the receptacle.

The first rod and the second rod can each extend from a lower surface of the head mount on opposing sides of the receptacle, and the first slot and the second slot can be defined through an upper surface of the base on opposing sides of the post.

The piece of jewelry can include a ring, a bracelet, earrings, a necklace, a pendant, a brooch, or any type of jewelry in which a jewel, such as a stone or other decoration is mounted thereto.

The present invention further relates to a method for securing a head mount to a base of a piece of jewelry. The method includes at least the step of placing a post extending from one of the base and the head mount into a receptacle defined by an inner wall of the other of the base and the head mount. The post includes a sidewall that defines a first circumferential groove. A spring retaining wall extends between an upper rim and a lower rim of a portion of the first circumferential groove. A circular spring is disposed within the first circumferential groove such that a portion of the circular spring is disposed in between the spring retaining wall and the sidewall. The inner wall that defines the receptacle further defines a second circumferential groove. The circular spring partially protrudes from the first circumferential groove into the second circumferential groove, retaining the head mount to the base.

The post can extend from an upper surface of the base and the head mount can include the inner wall defining the receptacle. The post can include a post head above the first circumferential groove. The post head can have a frusto-conical shape with an indent at a tip of the post head, the indent defining a conical shape.

The head mount can further include a first rod and a second rod, and the base defines a first slot and a second slot.

The method can further include inserting the first rod and the second rod into the first slot and the second slot, respectively.

The method can further include pulling the head mount off of the base against the bias of the circular spring. The circular spring is retained within the first circumferential groove by the spring retaining wall. The method can further include placing the post of the base into a receptacle of another head mount having another second circumferential groove. The circular spring partially protrudes from the first circumferential groove into the another second circumferential groove, retaining the another head mount to the base.

The method can further include adjoining the head mount to the base by a melting process, an adhesive bonding process, or a combination thereof.

It is to be understood that both the foregoing general description and the following detailed description are exemplary and explanatory only and are intended to provide a further explanation of the present invention, as claimed.

DETAILED DESCRIPTION OF THE INVENTION

Figure 1:
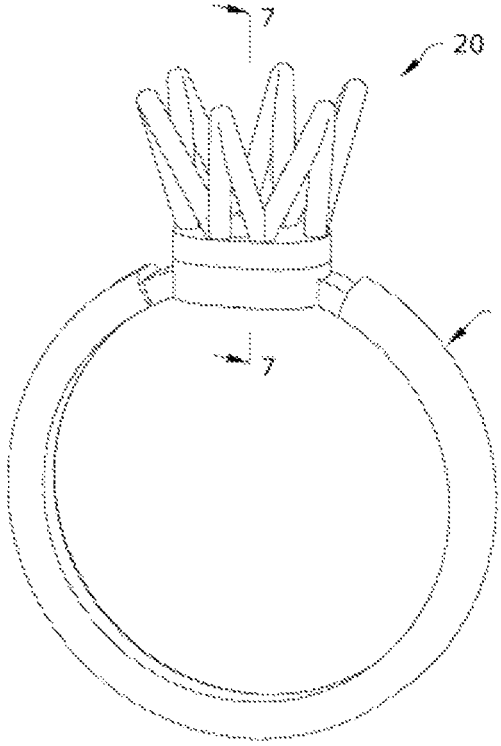
FIG. 1 is a perspective view of an interchangeable piece of jewelry, according to an embodiment of the present invention.

Jewelry having interchangeable head mounts and bases, and methods of mounting a head mount to a base are described herein.

According to the present invention, the interchangeable jewelry includes at least a base and a head mount. The head mount releasably secures to the base, allowing a customer to mix and match different bases and different head mounts together prior to selection. When a post is inserted to a receptacle of a head mount and a base of the present invention, a spring tension holds the head mount in place so that the customer can try the piece of jewelry on without the head mount separating from the base.

References herein to "an example" or "a specific example" or "an aspect" or "an embodiment," or similar phrases, are intended to introduce a feature or features of the interchangeable jewelry, or components thereof, or methods of using or manufacturing the interchangeable jewelry (depending on context), and that can be combined with any combination of previously-described or subsequently-described examples, aspects, embodiments (i.e. features), unless a particular combination of features is mutually exclusive or if context indicates otherwise. Further, as used in this specification, the singular forms "a," "an," and "the" include plural referents (e.g., at least one or more) unless the context clearly dictates otherwise.

The present invention includes an interchangeable piece of jewelry. The piece of jewelry at least includes a base and a head mount that are releasably attachable together.

The interchangeable piece of jewelry of the present invention can be used at a jewelry store. A customer can try different types of bases with different types of head mounts to determine a preferred pair of a base and a head mount for permanent mounting and purchase.

The base of the interchangeable jewelry can be part of any type of jewelry that includes a jewel, such as a stone or other type of decoration. For example, the base can be part of a ring, a bracelet, a pendant, a brooch, earrings, a necklace, and the like.

The head mount of the interchangeably jewelry includes a setting that can hold any type of jewel. The setting can include a prong setting having a plurality of adjustable prongs, a pave setting, a channel setting, a bezel setting, a pressure setting, or the like.

The base and the head mount can be made of a precious metal such as gold, silver, platinum, or palladium as well as other metals such as titanium, copper, tungsten, rhodium, nickel, ceramic, stainless steel, cobalt, and the like. The jewel can be any type of stone, such as but not limited to, diamonds, sapphires, rubies, emeralds, tanzanite, opals, topazes, and other types of precious, semi-precious stones, or other jewels and decorations.

The base includes an upper surface and the head mount includes a lower surface. A post extends from either the upper surface of the base or the lower surface of the head mount, while a receptacle is formed through the other of the upper surface of the base or the lower surface of the head mount. For example, the post extends from an upper surface of the base and the head mount includes the inner wall defining the receptacle. Alternatively, the post extends downward from the lower surface of the head mount and the base includes the inner wall defining the receptacle. The post fits within the receptacle.

The post includes a sidewall that defines a first circumferential groove. The first circumferential groove can completely encircle the post or partially encircle the post. The first circumferential groove extends radially inward towards a longitudinal axis of the post. The first circumferential groove can have a semi-circular cross section defined in between an upper circular rim and a lower circular rim. For example, the first circumferential groove can have a circular half pipe shape.

The receptacle is defined by an inner wall of the base or the head mount. The receptacle has an opening at an outer surface that is either the upper surface of the base or the lower surface of the head mount. The inner wall defines a second circumferential groove that extends radially outward away from a longitudinal axis of the receptacle. The second circumferential groove can have a semi-circular cross section defined in between an upper circular rim and a lower circular rim. For example, the second circumferential groove can have a circular half pipe shape.

When the post is inserted into the receptacle, the first circumferential groove at least partially aligns with the second circumferential groove. For example, the first circumferential groove can entirely line up with the second circumferential groove and can define a torus shape, such as a circular pipe. In such embodiments, the upper circular rim of the first circumferential groove abuts the upper circular rim of the second circumferential groove, while the lower circular rim of the first circumferential groove abuts the lower circular rim of the second circumferential groove. The diameter of the circular pipe is larger than the diameter of the spring, allowing room for the spring to compress and expand.

A spring retaining wall extends between an upper rim and a lower rim of a portion of the first circumferential groove. The spring retaining wall can cover or overlap less than 40%, less than 30%, less than 20%, less than 10%, less than 5%, or less than 1% of the first circumferential groove. The spring retaining wall can be a rod, a plate, a column, or the like. The spring retaining wall prevents a spring from dislodging from the first circumferential groove.

The spring retaining wall includes an inner surface facing towards the first circumferential groove, and an outer surface facing away from the first circumferential groove. A space is defined between the inner surface of the spring retaining wall and the sidewall at the first circumferential groove, providing clearance for the spring.

The spring retaining wall can include an upper end attached to the upper rim and extending downwards toward the lower rim. The spring retaining wall can include a lower end attached to the lower rim and extending upwards toward the upper rim.

The spring is disposed within the first circumferential groove when the head mount and base are detached and when the head mount and the base are attached. The spring can include any shape that fits within the first circumferential groove. For example, the spring can be circular shaped, square shaped, U-shaped, C-shaped, Z-shaped, D-shaped, S-shaped, triangular shaped, any polygonal shape, and the like.

In certain embodiments, the spring is a jump spring having a C-shape or circular shape with an opposed first end and second end facing one another and spaced apart from one another. In such a configuration, the spring can be secured around the first circumferential groove by pressing the first and second ends against the post such that the first and second ends spread apart against the bias of the spring until the spring wraps around the post within the first circumferential groove, in which the first and second ends bias back together. The spring can then be rotated around such that the spaced apart portion is opposite the spring retaining wall.

As mentioned above, when the post is within the receptacle, the first circumferential groove and the second circumferential groove partially or fully align with one another, forming a torus shaped space. When the spring is disposed within the first circumferential groove, and the post is disposed within the receptacle, the spring partially protrudes from the first circumferential groove into the second circumferential groove, releasably retaining the head mount to the base.

To attach the head mount to the base, the receptacle is urged over the post against the biased compression of the spring such that the first and second circumferential grooves can align and the spring can protrude from the first circumferential groove into the second circumferential groove. To remove the head mount from the base, the head mount can be pulled away from the base and, against the biased compression of the spring, the head mount can be removed from the base. This allows a user or customer to mix and match different types of head mounts with different types of bases to determine which match is preferred for permanent attachment and purchase.

In certain embodiments, the post includes a post head at its tip and above the first circumferential groove. The post head can include a conical shape, dome shape, or any shape that tapers towards the tip.

As mentioned above, the post can extend upward from the base, while the head mount defines the receptacle. In such embodiments, the post head can be disposed at the bottom of the setting. The post head can include a frustoconical shape having an indent at the tip. This allows the very bottom of a jewel that is secured within the setting to rest within the indent. As an example, the indent can define a conical shape to complement a pointed bottom end of the jewel. However, the indent can define any shape that complements the shape of the bottom end of the jewel.

The present invention can further include another male and female engagement to prevent the head mount and the base from being able to rotate or wobble relative to one another when the post is within the receptacle. As an example, at least one rod extends from one of the head mount and the base, and at least one slot is defined by the other of the head mount and the base. The rod fits within the slot when the post is disposed within the receptacle. However, other male and female engagements can be incorporated, such as any type of protrusion that fits within a receptacle.

The present invention can include a first rod and a second rod and a corresponding first slot and second slot. The first rod fits within the first slot and the second rod fits within the second slot when the post is disposed within the receptacle. The present invention can also include three or more rods and three or more corresponding slots.

In certain embodiments, the one or more rods can extend from a lower surface of the head mount and the one or more slots are defined through an upper surface of the base. Alternatively, the one or more rods can extend from an upper surface of the base and the one or more slots are defined through a lower surface of the head mount. In certain embodiment, one or more slots can be defined on the upper surface of the base, one or more slots can be defined on the lower surface of the head mount, one ore more rods can extend from the lower surface of the head mount, and one ore more rods can extend from the upper surface of the base.

Other than the one or more rods, the one or more slots, the receptacle, and the post, the upper surface of the base can be substantially planar and the lower surface of the head mount can be substantially planar. Substantially planar can mean that the surface is entirely planar or within 5% of being entirely planar. The planar upper surface and the planar lower surface can abut flush against one another. Further, the sidewalls of the head mount and the base can align and also provide a flush abutment. This allows for the head mount and base to be properly attached to one another without gaps and to look like a standard engagement ring once attached.

In use, a customer can enter a store and ask to try different head mounts with different bases. For example, if a customer is intending to purchase an engagement ring, the customer can pick a first head mount and a first base, and releasably attached the first head mount to the first base to view the appearance of the first base and first head mount. Due to the spring protruding from the first circumferential groove to the second circumferential groove, the customer can try the ring on without the first head mount falling off of the first base. The customer can than remove the first head mount from the first base, and releasably secure a second head mount to the first base, releasably secure the first head mount to a second base, releasably secure the second head mount to the second base or try other combinations. The customer can mix and match as many head mounts with as many bases as the jewelry store provides.

Once a customer decides to purchase a specifically paired head mount and base, the jeweler can adjust the paired head mount and base, fix the head mount to the base, polish the attached head mount and base, and sell the finished paired jewelry to the customer.

In alternative embodiments, the present invention can be provided as a set of trial bands and trial head mounts. In such embodiments, the trial bands and trial head mounts are not bonded together. Instead, the jeweler provides the matched head mount and base if available at the store, the jeweler can custom build the head mount and base, or the jeweler can order the matched head mount and base from a third party. All of the trial bands and the trial head mounts can then be used by other customers.

The present invention further includes a method for securing a head mount to a base of a piece of jewelry. The method includes placing a post extending from one of the base and the head mount into a receptacle defined by an inner wall of the other of the base and the head mount. The post includes a sidewall that defines a first circumferential groove. A spring retaining wall extends between an upper rim and a lower rim of a portion of the first circumferential groove. A circular spring is disposed within the first circumferential groove such that a portion of the circular spring is disposed in between the spring retaining wall and the sidewall. The inner wall that defines the receptacle further defines a second circumferential groove. The circular spring partially protrudes from the first circumferential groove into the second circumferential groove, retaining the head mount to the base. The head mount and the base of the method can include any of the structure and features described herein.

The method can further include the steps of pulling the head mount off of the base against the bias of the circular spring, wherein the circular spring is retained within the first circumferential groove by the spring retaining wall; and placing the post of the base into a receptacle of another head mount having another second circumferential groove. The circular spring partially protrudes from the first circumferential groove into the another second circumferential groove, retaining the head mount to the base. This method step can be performed as many times as possible or necessary.

The method can further include the step of adjoining the head mount to the base by a melting process, an adhesive bonding process, or a combination thereof. The melting process can include soldering, welding, and the like. This step can be taken after a customer has chosen a match for a head mount and a base for purchase.

Referring now to the figures, FIG. 1 shows a perspective view of an interchangeable piece of jewelry, according to an embodiment of the present invention. The interchangeable piece of jewelry includes a base 10 that is releasably attached to a head mount 20. In this example, base 10 and head mount 20 form a ring, such as an engagement ring.

Figure 2:
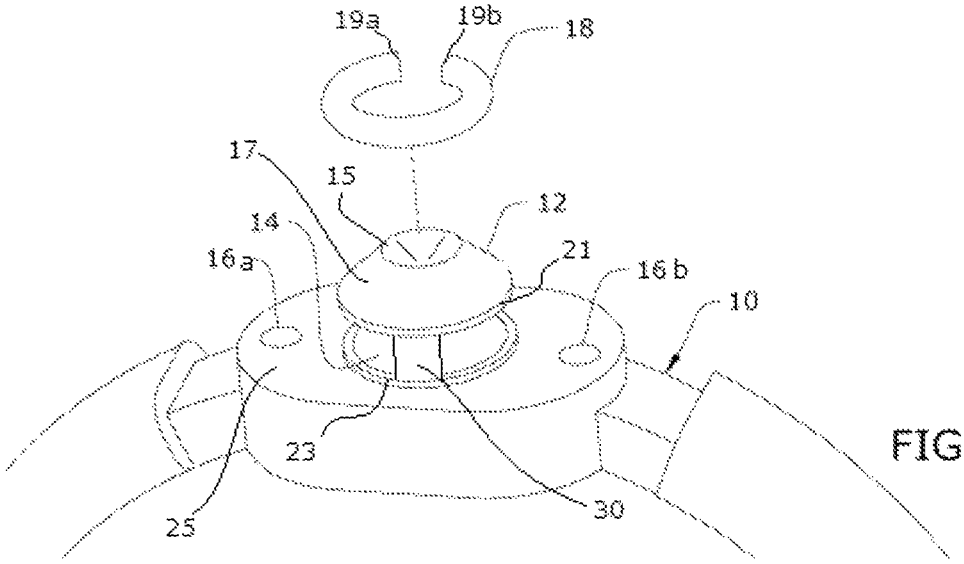
FIG. 2 is a top perspective view of a base and a jump ring of an interchangeable piece of jewelry, according to an embodiment of the present invention.

FIG. 2 is a top perspective view of base 10 and a jump ring 18 of an interchangeable piece of jewelry, according to an embodiment of the present invention. Base 10 includes an upper surface 25. Extending upward from upper surface 25 is a post 12.

Post 12 includes a sidewall defining an upper rim 21, a lower rim 23, and a first circumferential groove 14 disposed in between upper rim 21 and lower rim 23. First circumferential groove 14 completely encircles post 12. First circumferential groove 14 extends radially inward towards a longitudinal axis of post 12. First circumferential groove 14 has have a semi-circular cross section, and upper rim 21 and lower rim 23 are circular shaped.

Post 12 includes a post head 17 at its tip. Post head 17 is above first circumferential groove 14. Post head 17 includes a frustoconical shape with an indent 15 at its tip and thus post 12 has a mushroom like shape. Indent 15 defines a conical shape.

Post 12 further includes spring retaining wall 30. Spring retaining wall 30 extends between upper rim 21 and lower rim 23 of a portion of first circumferential groove 14. The spring retaining wall 30 is a plate. Spring retaining wall 30 prevents jump ring 18 from dislodging from first circumferential groove 14.

Spring retaining wall 30 includes an inner surface facing towards first circumferential groove 14, and an outer surface facing away from first circumferential groove 14. A space is defined between the inside surface of spring retaining wall 30 and the sidewall at the first circumferential groove 14, providing clearance for jump ring 18.

Spring retaining wall 30 includes an upper end attached to upper rim 21 and extending downwards toward lower rim 23. Spring retaining wall 30 includes a lower end attached to lower rim 23 and extending upwards toward upper rim 21.

A first slot 16*a* and a second slot 16*b* are defined through upper surface 25 and into base 10. First slot 16*a* and second slot 16*b* are disposed on opposing sides of base 10. First slot 16*a* and second slot 16*b* are shaped and sized to receive posts of head mount 20, shown in FIG. 1.

The spring shown in FIG. 2 is a circular spring and is considered a jump ring 18. Jump spring 18 has a first end 19*a* and an opposing second end 19*b* that are spaced apart at a certain distance when the spring as at rest. FIG. 2 illustrates jump spring 18 detached from post 12.

Figure 3:
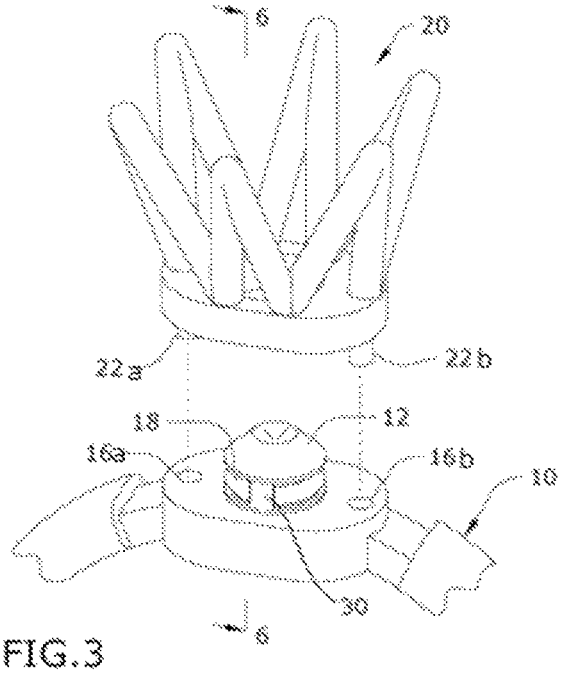
FIG. 3 a top perspective exploded view of an interchangeable piece of jewelry, according to an embodiment of the present invention.

FIG. 3 a top perspective exploded view of an interchangeable piece of jewelry, according to an embodiment of the present invention. FIG. 3 shows jump ring 18 disposed within first circumferential groove 14 shown in FIG. 2. As shown in FIG. 3, base 10 includes post 12 extending upward therefrom, first slot 16*a*, second slot 16*b*, and spring retaining wall 30. Spring retaining wall 30 prevents jump ring 18 from exiting or being dislodged from post 12. Head mount 20 includes a first rod 22*a* and a second rod 22*b* extending downwardly therefrom, the first rod 22*a* and the second rod 22*b* shaped and sized to fit within first slot 16*a* and second slot 16*b*, respectively.

Figure 4:
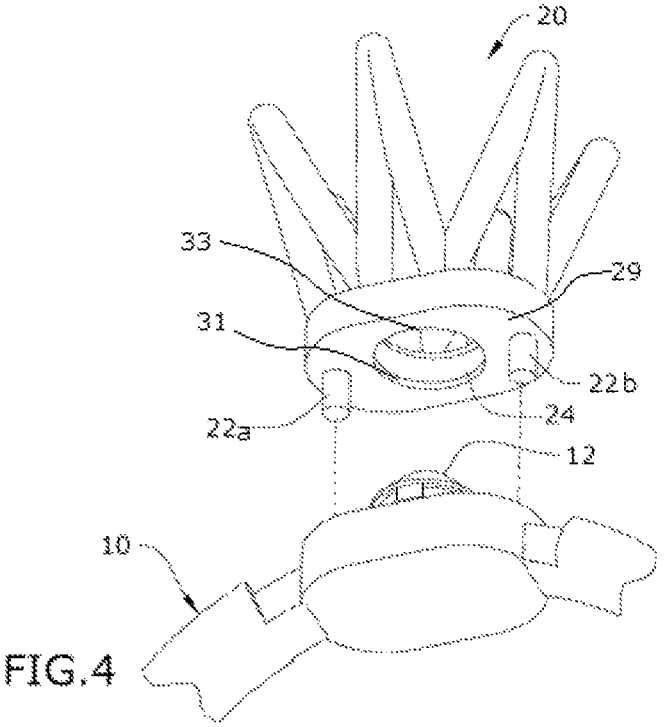
FIG. 4 is a bottom perspective exploded view of an interchangeable piece of jewelry, according to an embodiment of the present invention

FIG. 4 is a bottom perspective exploded view of an interchangeable piece of jewelry, according to an embodiment of the present invention. FIG. 4 shows base 10 with post 12 upwardly extending therefrom, and further shows a bottom of head mount 20. Head mount 20 includes an opening at an outer surface 29 (bottom surface) that leads to an inner wall 31, defining a receptacle 33. Inner wall 31 further defines a second circumferential groove 24. A first rod 22*a* and a second rod 22*b* extend downwardly from outer surface 29.

Second circumferential groove 24 extends radially outward away from a longitudinal axis of receptacle 33. Second circumferential groove 24 has a semi-circular cross section defined in between an upper circular rim and a lower circular rim.

Figure 5:
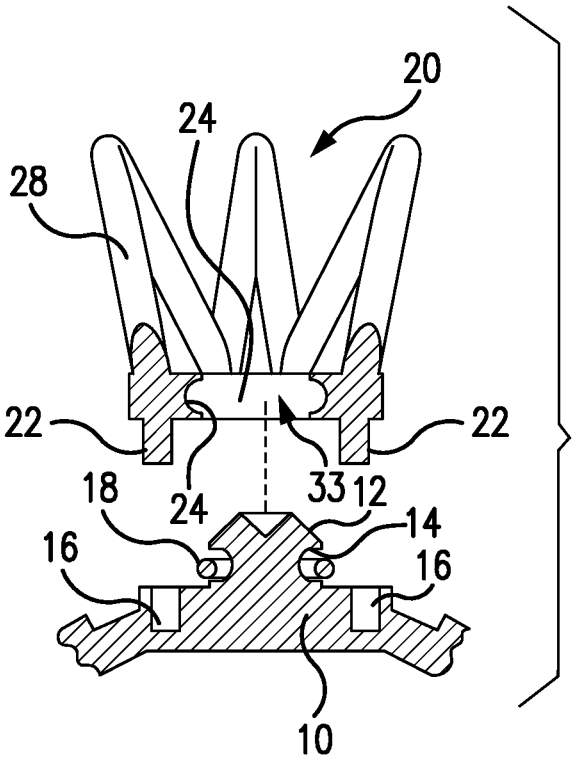
FIG. 5 is a cross-sectional side view of the interchangeable piece of jewelry shown in FIG. 3 taken along line 6-6, depicting the base and the head mount prior to being attached.

FIG. 5 is a cross-sectional side view of the interchangeable piece of jewelry shown in FIG. 3 taken along line 6-6, depicting base 10 and head mount 20 prior to being attached.

Head mount 20 includes rods 22 and receptacle 33 with second circumferential groove 24. Head mount 20 further includes prongs 28 for securing a jewel therein. Base 10 includes slots 16, post 12, and first circumferential groove 14. Jump ring 18 is disposed within first circumferential groove 14.

Figure 6:
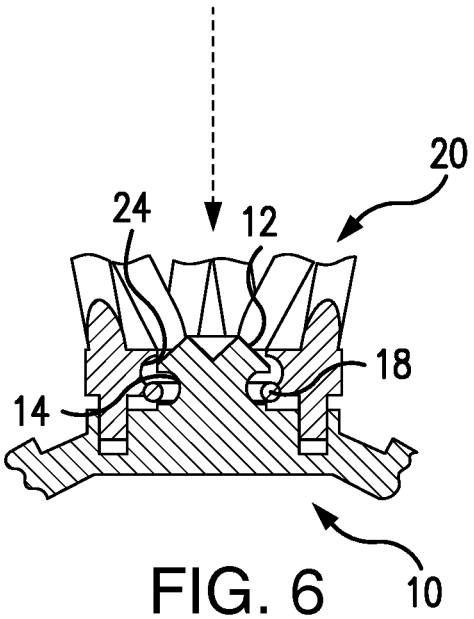
FIG. 6 is a cross-sectional side view of the interchangeable piece of jewelry shown in FIG. 5, depicting the base in a process of being releasably attached to the head mount.

FIG. 6 is a cross-sectional side view of the interchangeable piece of jewelry shown in FIG. 5, depicting base 10 in a process of being attached to head mount 20. As can be seen, post 12 fits within receptacle of head mount 20. As head mount 20 is pressed downward towards base 10, the lower circular rim of second circumferential groove 24 compresses jump ring 18 towards first circumferential groove 14 and against a bias of the spring. During the process of attaching head mount 20 to base 10, the rods are inserted into the slots.

Figure 7:
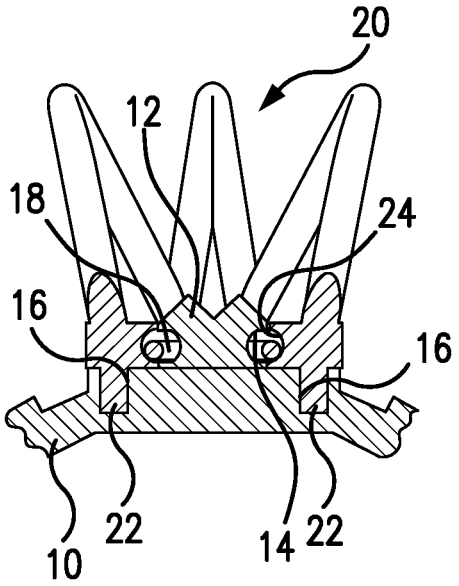
FIG. 7 is a cross-sectional side view of the interchangeable piece of jewelry shown in FIG. 1 taken along line 7-7, depicting the base attached to the head mount.

FIG. 7 is a cross-sectional side view of the interchangeable piece of jewelry shown in FIG. 1 taken along line 7-7, depicting base 10 attached to head mount 20. The rods 22 are within slots 16, preventing head mount 20 from rotating, rocking, or loosening, relative to base 10. When the post 12 is inserted into the receptacle, first circumferential groove 14 lines up with second circumferential groove 24 and defines a torus shape. The spring bias imparted by the lower circular rim against jump ring 18, as shown in FIG. 6, is released such that jump ring 18 is disposed in first circumferential groove 14 and second circumferential groove 24, preventing head mount 20 from separating from base 10, unless a threshold pulling force is applied.

FIG. 7 further illustrates post head disposed at the bottom of the setting. The post head has a frustoconical shape with an indent at the tip. This allows the very bottom of a jewel that is secured within the setting to rest within the indent.

Figure 8:
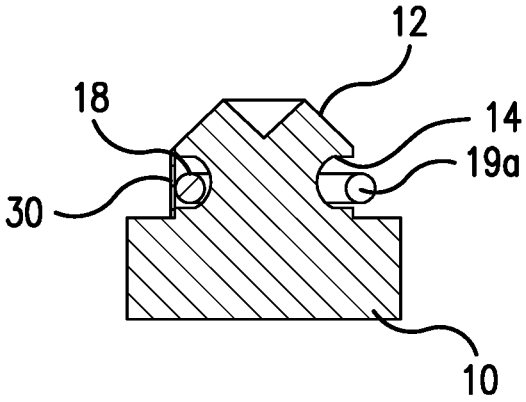
FIG. 8 is a cross sectional front view of a base of the interchangeable piece of jewelry, according to an embodiment of the present invention.

FIG. 8 is a cross sectional front view of a base 10 of the interchangeable piece of jewelry, according to an embodiment of the present invention. Base 10 includes first circumferential groove 14, post 12, and indent 15 at the tip of post 12. Jump spring 18 is disposed within first circumferential groove 14, such that the first end 19*a* and the second end are opposite spring retaining wall 30. As can be seen, spring retaining wall 30 prevents jump spring 19*a* from exiting or dislodging from first circumferential groove 14.

The disclosure herein refers to certain illustrated examples, it is to be understood that these examples are presented by way of example and not by way of limitation. The term "about," as it appears herein, is intended to indicate that the values indicated can vary by plus or minus 5%. The intent of the foregoing detailed description, although discussing exemplary examples, is to be construed to cover all modifications, alternatives, and equivalents of the examples as can fall within the spirit and scope of the invention as defined by the additional disclosure.

The entire contents of all cited references in this disclosure, to the extent that they are not inconsistent with the present disclosure, are incorporated herein by reference.

The present invention can include any combination of the various features or embodiments described above and/or in the claims below as set forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. An interchangeable piece of jewelry comprising:

a base;

a head mount comprising a setting configured to retain a jewel therein;

a post extending from one of the base and the head mount, the post comprising a sidewall that defines a first circumferential groove;

a spring disposed within the first circumferential groove; and a spring retaining wall that extends between an upper rim and a lower rim of a portion of the first circumferential groove, wherein a space is defined between an inside surface of the spring retaining wall and the sidewall at the first circumferential groove, a receptacle is defined by an inner wall of the other of the base and the head mount, the receptacle having an opening at an outer surface, the inner wall defining a second circumferential groove, and when the post is disposed within the receptacle, the spring partially protrudes from the first circumferential groove into the second circumferential groove, retaining the head mount to the base.

2. The interchangeable piece of jewelry of claim 1, wherein the base is part of a ring.

3. The interchangeable piece of jewelry of claim 1, wherein the spring is a jump ring comprising an opposed first end and second end facing one another and spaced apart from one another.

4. The interchangeable piece of jewelry of claim 1, wherein the setting of the head mount comprises a plurality of adjustable prongs.

5. The interchangeable piece of jewelry of claim 1, wherein the post is extending from an upper surface of the base and the head mount comprises the inner wall defining the receptacle.

6. The interchangeable piece of jewelry of claim 1, wherein the post comprises a post head above the first circumferential groove, the post head comprising a conical shape.

7. The interchangeable piece of jewelry of claim 6, wherein the conical shape of the post head is a frustoconical shape comprising an indent at a tip of the post head, the indent defining a conical shape.

8. The interchangeable piece of jewelry of claim 1, further comprising at least one rod extending from one of the head mount and the base, and at least one slot defined by the other of the head mount and the base, wherein the rod fits within the slot when the post is disposed within the receptacle.

9. The interchangeable piece of jewelry of claim 8, wherein the at least one rod is a first rod and a second rod, and the at least one slot is a first slot and a second slot, wherein the first rod fits within the first slot and the second rod fits within the second slot when the post is disposed within the receptacle.

10. The interchangeable piece of jewelry of claim 9, wherein the first rod and the second rod each extend from a lower surface of the head mount on opposing sides of the receptacle, and the first slot and the second slot are defined through an upper surface of the base on opposing sides of the post.

11. The interchangeable piece of jewelry of claim 8, wherein the rod extends from a lower surface of the head mount and the slot is defined through an upper surface of the base.

12. The interchangeable piece of jewelry of claim 1, wherein the spring retaining wall comprises an upper end attached to the upper rim and a lower end attached to the lower rim.

13. A method for securing a head mount to a base of a piece of jewelry comprising:

placing a post extending from one of the base and the head mount into a receptacle defined by an inner wall of the other of the base and the head mount, wherein the post comprises a sidewall that defines a first circumferential groove, a spring retaining wall extends between an upper rim and a lower rim of a portion of the first circumferential groove, a spring is disposed within the first circumferential groove such that a portion of the spring is disposed in between the spring retaining wall and the sidewall, the inner wall that defines the receptacle further defines a second circumferential groove, and the spring partially protrudes from the first circumferential groove into the second circumferential groove, retaining the head mount to the base.

14. The method of claim 13, wherein the base is part of a ring.

15. The method of claim 13, wherein the post is extending from an upper surface of the base and the head mount comprises the inner wall defining the receptacle.

16. The method of claim 15, wherein the post comprises a post head above the first circumferential groove, the post head comprising a frustoconical shape comprising an indent at a tip of the post head, the indent defining a conical shape.

17. The method of claim 15, further comprising:

pulling the head mount off of the base against the bias of the circular spring, wherein the circular spring is retained within the first circumferential groove by the spring retaining wall; and placing the post of the base into a receptacle of another head mount having another second circumferential groove, wherein the circular spring partially protrudes from the first circumferential groove into the another second circumferential groove, retaining the another head mount to the base.

18. The method of claim 13, wherein the head mount further comprises a first rod and a second rod, and the base defines a first slot and a second slot, wherein the method further comprises inserting the first rod and the second rod into the first slot and the second slot, respectively.

19. The method of claim 13, further comprising:

adjoining the head mount to the base by a melting process, an adhesive bonding process, or a combination thereof.

* * * * *